US006769283B2

(12) United States Patent
Suresh

(10) Patent No.: US 6,769,283 B2
(45) Date of Patent: Aug. 3, 2004

(54) SWAGING DEVICE

(75) Inventor: Srinivas B. Suresh, Cerritos, CA (US)

(73) Assignee: Sierracin Corporation, Sylmar, CA (US)

( * ) Notice: Subject to any disclaimer, the term of this patent is extended or adjusted under 35 U.S.C. 154(b) by 0 days.

(21) Appl. No.: 10/105,668

(22) Filed: Mar. 25, 2002

(65) Prior Publication Data

US 2003/0177809 A1 Sep. 25, 2003

(51) Int. Cl.[7] ..... B21D 39/00

(52) U.S. Cl. ..... 72/416; 72/453.16; 72/413; 29/237

(58) Field of Search ..... 72/416, 413, 453.16, 72/453.15, 402; 29/237, 751, 753

(56) References Cited

U.S. PATENT DOCUMENTS 5,069,058 A 12/1991 Hyatt
5,195,354 A * 3/1993 Yasui et al. ..... 72/453.03
6,101,862 A * 8/2000 Rzasa et al. ..... 72/413

* cited by examiner

*Primary Examiner*—Daniel C. Crane
(74) *Attorney, Agent, or Firm*—Wean Khing Wong

(57) ABSTRACT

A swaging device is provided, including a die holder assembly including a head and a die block adapted to hold a first die and a second die respectively, and an actuator assembly, including a housing and a piston connected to the die block. In addition, a separate, removable strut cap is included, which is engaged to both the housing and the head. The strut cap is structured to secure the head during the compression of a workpiece.

19 Claims, 3 Drawing Sheets

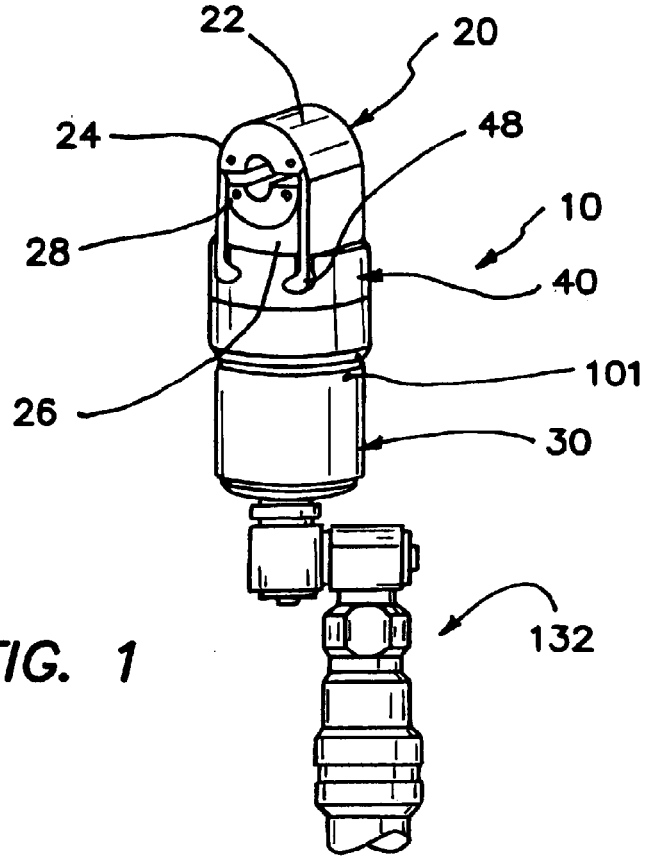
FIG. 1
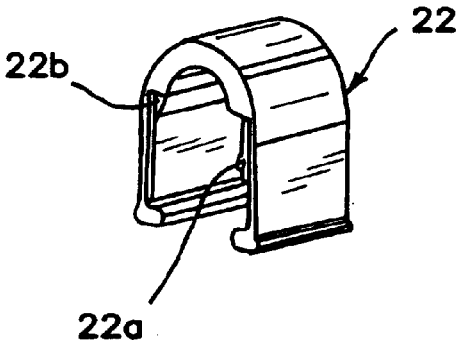
FIG. 2A
FIG. 2B
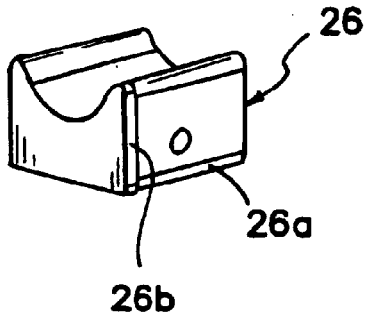

SWAGING DEVICE

BACKGROUND OF THE INVENTION

The present invention generally relates to a swaging device and more specifically relates to a tool for swaging hydraulic fittings, for example, as used in the aircraft industry and the like.

Swaged fittings for use in connecting tubes, for example metallic tubes in hydraulic systems, have been used for many years. The tubes are inserted into a fitting, usually comprising a cylindrical sleeve, and then the fitting is swaged with a swaging tool to produce a fluid-tight connection between the tubes. For example, during a swaging operation, the fitting is compressed radially inwardly by the swaging tool. This causes annular ridges on an outer surface of the fitting to be flattened and transferred to an inner surface thereof. As a result, annular indentations are formed in the tube, attaching it securely to the fitting.

In certain types of swaging operations, for example, in the aircraft industry, access to the fitting to be swaged may be very limited. As a result, there has existed a need for a swaging tool that will accomplish the swaging operation, yet be compact enough to gain access to the fitting. One relatively compact swaging tool is disclosed in U.S. Pat. No. 3,848,451, herein incorporated by reference in its entirety, comprising an upper die held within a yoke and a lower die connected to the tool by a die holder. The yoke is removed by loosening a knurled nut, allowing the yoke to be separated from the remainder of the tool for initial connection to the fitting to be swaged. Despite the advances provided by this tool in terms of its relatively compact nature and versatility, there still remain situations where the ability of the tool to swage a fitting becomes very difficult and, at times, not possible.

Tubes in aircraft hydraulic systems are connected using separable and permanent type of joints. Fittings are generally made of cylindrical sleeves to receive tubes at both ends. The sleeve will be compressed externally, thereby creating radial deformation of the tubes. The pre-determined compression of fitting is done by the use of a swage tool. The fitting design makes the joint secure, fluid tight and able to withstand external environmental factors.

Early swaging tools were large and bulky and were not suitable for swaging tubes in aircraft because of the tight spacing between tubes.

The design features of a swaging tool must cater to demanding stringent aircraft assembly requirements, such as prevention of misuse, rework and must be fast and accurate. Mistakes in swaging are often extremely expensive to correct. Naturally, aircraft safety depends primarily on the performance of hydraulic systems which control the aircraft maneuvers and a faulty swage could be unsafe.

U.S. Pat. No. 5,069,058 to Hyatt, which is incorporated herein, in its entirety, by this specific reference, discloses a compact swaging tool having a removable head containing swaging dies.

Unfortunately, there are some drawbacks associated with the tool disclosed in the Hyatt patent and others similar thereto. For example, the removable connection between the die head and the cylinder is accomplished by a tongue and groove arrangement. Although this design prevents use of the tool when the tool is improperly assembled, the die head can be prone to sliding during swaging and can be unacceptably unstable in some circumstances, particularly when subjected to high stresses over an extended period of time.

There is still a need for a compact, lightweight swaging tool that is reliable even when subjected to substantial stresses during the swaging operation.

SUMMARY OF THE INVENTION

Accordingly, swaging devices are provided by the present invention for use in swaging hydraulic fittings and the like, for example to join together open ends of two tubes. The present swaging devices are strong and reliable in use and are useful for swaging those workpieces disposed in cramped quarters or difficult to access areas. The present devices are straightforward in construction and design and inexpensive to manufacture. Moreover, the present devices can be utilized with conventional, readily available swage dies.

Generally, a swaging device in accordance with the present invention generally comprises a die holder assembly and an actuator assembly. The die holder assembly includes a head, for example a substantially un-shaped head adapted to hold a first die, for example a conventional swage die, and a die block adapted to hold a second die, for example an identical second die.

The actuator assembly preferably comprises a housing, for example, a cylindrical housing, and a hydraulically operable dual piston mechanism within the housing.

The piston mechanism with the housing is adapted to move the second die toward the first die to swage a workpiece or fitting. Preferably, the pistons are separated by a sleeve member which define an upper and a lower chamber. More specifically, an upper piston having a head reciprocally retained within the upper chamber defined by the sleeve member has a rod connected to the die block. A lower piston having a head reciprocally retained within the lower chamber defined by a lower portion of the housing, has a rod slidably extending through a bore in the sleeve member and a head which abuts with a base of the sleeve member. The two pistons are biased to a retracted position, for example, by a return spring. The second piston includes an axial passageway for providing fluid communication between the upper and lower chambers when fluid is supplied to the cylinder to move the pistons and, thus, the lower die toward the upper die during the swaging operation.

The housing has a substantially closed proximal end with an exception of a fluid port defined therein, and an open distal end and sized to receive the piston mechanism during assembly.

Importantly, the swaging device of the present invention further comprises a stabilizing member (hereinafter "strut cap") which is removably engaged to both the die holder assembly and the actuator assembly. More particularly, the strut cap includes a distal portion adapted to engage a proximal portion of the head, and a proximal portion adapted to engage a distal portion of the actuator assembly housing.

Preferably the strut cap is designed and adapted to control and uniformly distribute stresses, particularly principal stresses, for example compressive or longitudinal forces exerted on the device during the swaging operation. For example, the strut cap may include a pair of parallel grooves, each having a substantially uniform near circular cross section for accommodating the head. Correspondingly, the head of the die holder assembly has a proximal portion defined by two substantially parallel legs which are shaped to be received in the strut cap grooves. More specifically, these legs terminate in free ends which fit within the near circular grooves of the strut cap.

Structure is provided for facilitating proper positioning and alignment of the various components of the device, particularly for substantially preventing misalignment, for example improper assembly, between the strut cap, the head and the die holder. Such structure may include for example tabs, grooves, projections and/or recesses defined on these particular engagable components of the device. In addition, a mechanism may be provided for relieving excess pressure on the strut cap in case the device is pressurized without the head and/or die holder in place. For example, a pressure relief port may be defined within the housing.

BRIEF DESCRIPTION OF THE DRAWINGS

The present invention will be more clearly understood and appreciated with reference to the following Detailed Description, when considered in conjunction with the appended Drawings of which:

FIG. 1 is a perspective view of a swaging device having a set of swaging dies connected thereto, in accordance with the present invention;

FIG. 2*a* is a perspective view of a head of the swaging device shown in FIGS. 1 and 2;

FIG. 2*b* is a perspective view of a die block of the swaging device shown in FIGS. 1 and 2;

DETAILED DESCRIPTION

Figure 3:
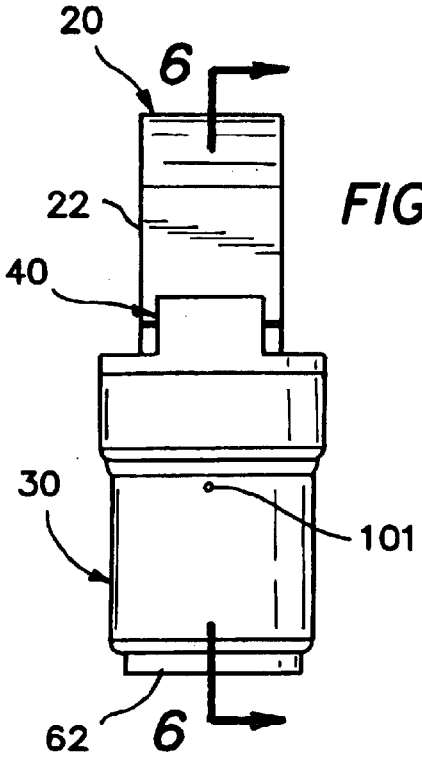
FIG. 3 is a side view of the swaging device shown in FIGS. 1 and 2.
Figure 2:
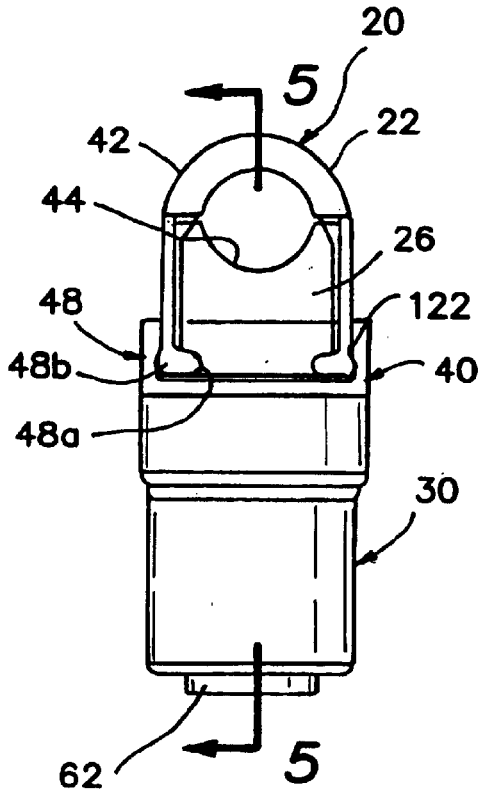
FIG. 2 is a front view of the swaging device shown in FIG. 1 with the swaging dies removed.

Turning now to FIGS. 1, 2 and 3, a swaging device 10, in accordance with the present invention is shown. The device 10 generally comprises a die holder assembly 20, including a head 22 adapted to hold a first die 24 and a die block 26 adapted to hold a second die 28.

For the sake of clarity, the first die 24 and second die 28 are not shown in FIGS. 2 and 3. It is further noted that the first and second die 22, 24 preferably comprise standard, currently available die used with conventional swaging tools. The device 10 further comprises an actuator assembly 30 adapted to drive the die block 26 toward the head 22 in order to compress a workpiece, for example a fitting circumscribing a pair of metal tubes or pipes (not shown), positioned between therebetween. In addition, the swaging device comprises a stabilizing member, or strut cap 40 which is removably engaged to both the die holder assembly 20 and the actuator assembly 30 and adapted to secure the head 22 during the swaging procedure.

The swaging device 10 preferably includes structure for facilitating and/or ensuring correct alignment and positioning of components thereof during use. For example, turning now to FIGS. 2*a* and 2*b*, the head 22 may include one or more inwardly projecting tabs 22*a* (see FIG. 2*a*), and the strut cap 40 may include a recessed edge 26*a* for accommodating the tabs 22*a* to ensure that the head 22 can only be engaged to the strut cap 40 in a single orientation. Similarly, the die block 26 may include structure, for example, projection 26*a* to be accommodated by a corresponding recessed portion 22*b* on head 22 to ensure correct positioning and alignment between the strut cap 26 and the head 22 during use. Other structural arrangements are possible and are considered to be within the scope of the present invention.

Figure 6:
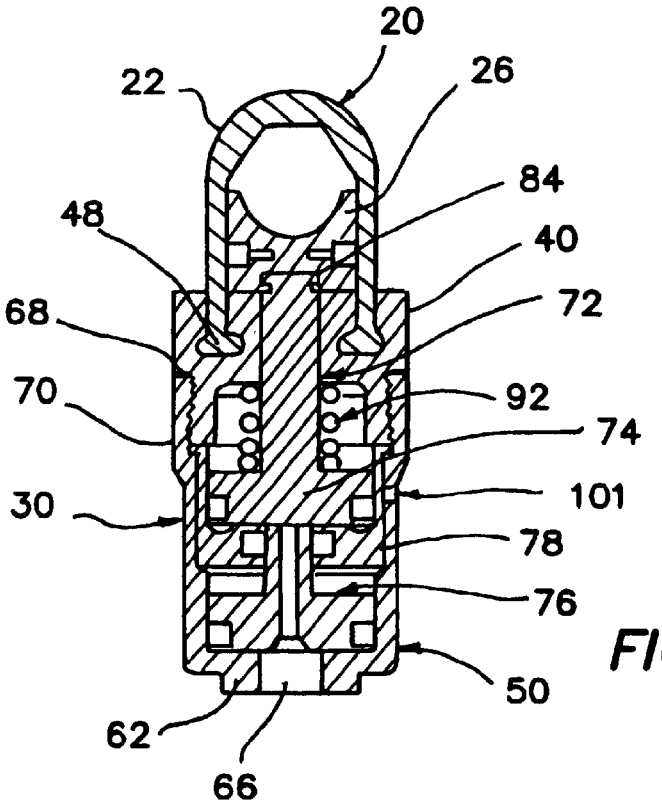
FIG. 6 is a cross sectional view taken along line 6—6 of FIG. 3.
Figure 4:
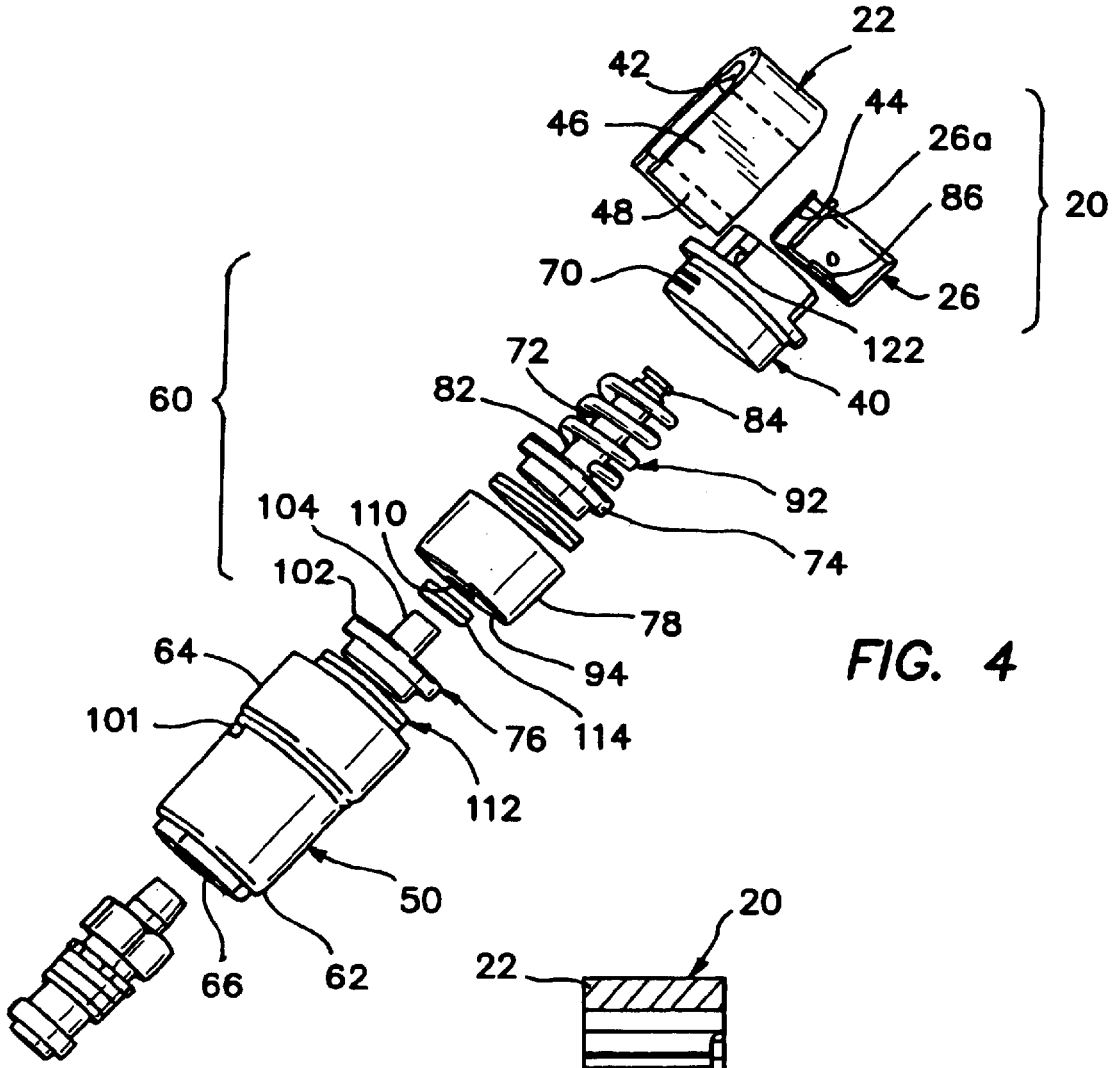
FIG. 4 is an exploded view of the swaging device shown in FIGS. 1 and 2.
Figure 5:
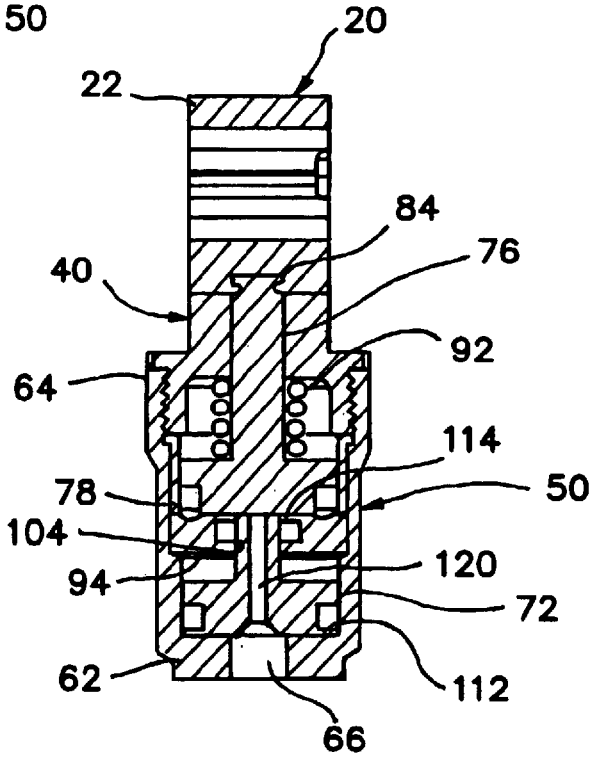
FIG. 5 is a cross-sectional view taken along line 5—5 of FIG. 2.

The present invention may be more clearly understood with reference to FIGS. 4–6.

The die holder assembly 20 is preferably designed to be engageable with currently available swage dies. For example, the head 22 and die block 26 are preferably provided with surfaces 42 and 44 respectively, adapted to removably engage complementary surfaces of a set of swage dies, such as the swage dies 24, 28 shown in FIG. 1. The head is substantially U-shaped and includes legs 46 terminated in free ends 48, for example rounded, near circular free ends.

Referring back now briefly to FIG. 1, the first die 24 and the second die 28 may be substantially identical unitary members each having a curved surface for receiving a portion of the fitting to be swaged. The dies 24, 28 are preferably made of a metal alloy capable of withstanding substantial fatigue and compressive forces. For example, the dies 24, 28 can be made of a material comprising Aermet alloy, which is known to have excellent fatigue and toughness properties. To increase the strength of the dies 24, 28, they may be heat treated by double aging at about 900° Fahrenheit, for about 3 hours each time, after solution treating at a higher temperature.

Many of the components of the device 10 of the present invention are preferably constructed from high tensile strength materials, such as precipitated hardened stainless steel, Aermet alloy, or other high tensile strength materials.

Dies suitable for use with the present invention are well known in the industry and are therefore not explained in further detail. U.S. Pat. Nos. 5,069,058 and 3,848,451, herein already expressly incorporated by reference, describe the desirable properties of such dies.

Turning back now to FIGS. 4–6, the actuator assembly 30 preferably comprises a housing 50 and a piston mechanism 60 contained in the housing 50. The housing 50 may be substantially cylindrical in shape, preferably including an integral, substantially closed proximal end 62 and an open distal end 64. The proximal end 62 includes a fluid inlet 66 for providing fluid pressure to the piston mechanism 60. The open distal end 64 has threads 68, preferably internal as shown, for engaging corresponding threads on a proximal portion 70 of the strut cap 40. The inside surface of the housing 50 preferably has a ground finish for providing 10,000 psi seals.

The piston mechanism 60 preferably comprises a fluid operable piston mechanism. In the specific embodiment shown in the Figures, the piston mechanism 60 comprises a first or upper piston 72 and a second or lower piston 76. More specifically, the upper piston 72 includes a head 74 which is slidably retained within a sleeve member 78, and a rod 82 extending upwardly through an axial passage in the housing 50 and the strut cap 40. A flanged portion 84 of the rod 82 is received within a slotted recess 86 in the die block 26 and is secured thereto. A return spring 92 is positioned around the rod 82 as shown. The return spring 92 functions to bias the upper piston 72 against a base 94 of the sleeve member 78 in the absence of fluid pressure.

FIGS. 1, 3 and 6 show another advantageous feature of the present invention. Specifically, suitable means for relieving excessive pressure within or against the actuator assembly 30, for example against the strut cap 40, are preferably provided. For example, a fluid pressure relief port 101, defined in the housing 50, may be provided, which is designed to substantially prevent damage to the strut cap 40 in an event wherein the swaging tool 10 is inadvertently pressurized without the head 22 and/or die block 26 in place. Pressure within the housing 50 is relieved when the piston 72 moves distally thereby exposing and opening the relief port 101.

As shown, the lower piston 76 has a cylindrical head 102 reciprocally retained within the proximal portion 62 of the housing 50, and a rod 104 extending distally through an axial opening 110 of the sleeve member base 94. Preferably, the lower piston 76 includes seal 112. The head 102 of the lower piston 76 abuts the base 94 of the sleeve member 78 and the rod 104 of the lower piston 76 has a fluid passageway 120 to provide the fluid communication necessary for operation of the piston mechanism 60. Although this embodiment 10 of the present invention utilizes the piston mechanism 60 described and shown herein, it is to be appreciated that other suitable means for driving the second die forcefully toward the first die in order to swage a fitting may be alternatively provided. In larger tools, by adding one more set of mechanism 60, the tool outside diameter could be reduced, thereby reducing its weight.

During the swaging operation, fluid is pumped through inlet 66. The upper piston 72 is thereby moved distally to force the second die 28 toward the first die 24 (see FIG. 1). Upon buildup of fluid pressure, the dies 24, 28 are forced against the workpiece (tube fitting) to cause the swaging thereof. When the swaging operation is complete, the return spring 92 causes the second die 28 to be retracted from the first die 24. The swaging device 10 utilizes this double piston arrangement described hereinabove for enhanced swaging force and rapid retraction.

Importantly, the die holding assembly 20 is preferably not directly connected to the actuator assembly housing 50. The strut cap 40 is designed to positively secure the die holding assembly during swaging, and reduce the weakening and wearing of the actuator mechanism 30 over time. As shown, the die holding assembly head 22 is connected by free ends 48 to a distal portion of the strut cap 40. A latching member or other connector may be provided to keep the head 22 in place on the strut cap 40.

Preferably, the device 10 is adapted to withstand stresses of up to about 200 Ksi, or even up to about 220 Ksi. Components of the device 10 are preferably made of a suitable material, for example Ph 13-8, a metal alloy known to those of skill in the art, which has a high fatigue strength and ultimate tensile strength of up to about 200 Ksi. Aermet alloy is also an option for the components of the device 10. The strut cap 40 includes substantially near circular shaped grooves 122 adapted to engage the free ends 48 of the head 22. As shown, the free ends 48 of the head 22 are near circular in form, defined for example by relatively flattened outer surfaces 48*a* and projecting inner portion 48*b*. This feature provides consistent and substantially uniform distribution of principal stresses to the head 22 during swaging. The threaded proximal portion 70 of the strut cap 40 engages the housing distal portion 64. Preferably, the strut cap 40 is received in the housing as shown such that the housing distal portion 64 circumscribes the strut cap proximal portion 70.

The swaging device 10 is adapted to be connected to a conventional fitting, for example a swivel fitting 132 shown in FIG. 1, for providing the appropriate fluid pressure and control to the device 10.

The structure of the present invention as described and shown advantageously increases the useful life of the swaging device 10 when compared to conventional swaging tools.

Operation of the swaging device 10 may be as follows. In order to make a swaged tube connection, the tube (not shown) is marked for insertion length and then inserted in to a fitting. The die block 26 is engaged with the upper piston 72 in the device 10 by sliding it over the piston flanged end 84.

The die block 26 is now placed under the fitting to be swaged. The head with the upper die half (i.e. first die 24) is placed over the tube and moved to be in engagement with the strut cap 40 and the die block 26. Now, at this point, the device 10 is in a position ready for swaging. It must be ensured that the device 10 is fully engaged and is free from any external forces.

When hydraulic pressure, such as a pressure of about 10,000 psi, from a pump is applied to the device, the lower piston 76 moves upwards and pushes the upper piston 72. Also, the high pressure fluid passes through the passage 120 in the lower piston 72 and pushes the upper piston 76. The die block 26 having been attached to the upper piston, also moves along with the die half located in it. There are three oil seals inside of the housing. One is on the top piston to prevent oil from escaping above the upper piston in to the upper chamber. The oil seal on the lower piston prevents oil from escaping out of the lower chamber. The rod seal provided in the sleeve seals the two chambers above and below it.

The dies 24, 28 compress the fitting and in turn the tube. When the dies reach the pre-determined diameter, the pressure is dropped. The springs 92 causes the pistons 72, 76 to retract and expel the fluid from the tool. The head 22 is dis-engaged and the tool withdrawn from the fitting. The swaging operation is now complete. An inspection gage will be used to check the quality of swage.

While the description above refers to particular embodiments of the present invention, it will be understood that many modifications may be made without departing from the spirit thereof. For example, one additional piston mechanism 60 could be added to the existing piston mechanism 60 in order to make the actuator outside diameter smaller but longer. The diameter of the actuator is preferably as small as possible for large size tools in order to facilitate access and reduce work fatigue while swaging in tight overhead situations, for example. Further, aspects of the invention may have combinations of the above described embodiments although these combinations may not be explicitly described. The accompanying claims are intended to cover such embodiments as would fall within the true scope and spirit of the present invention.

What is claimed is:

1. A swaging device comprising:

a die holder assembly including a head adapted to hold a first die and a die block adapted to hold a second die, the head being a unitary structure including two fixed substantially parallel legs of substantially equal length;

an actuator assembly including a housing having a first portion with an internal threaded surface, and said housing being adapted to drive the die block toward the head in order to compress a workpiece positioned therebetween; and a strut cap including two grooves structured to slidably receive the two fixed substantially parallel legs of the head, and further including a second portion with an external threaded surface structured to engage internal threaded surface of the first portion of the housing, the strut cap being removably engaged to both the die holder assembly and the actuator assembly, and the strut cap being structured to secure the head during compression of the workpiece.

2. The device of claim 1 wherein the actuator assembly further comprises a piston mechanism contained within the housing.

3. The device of claim 1 wherein each of the legs terminates in an end having a near circular cross section.

4. The device of claim 1 wherein the strut cap is structured to withstand principal stresses of up to about 200 Ksi.

5. The device of claim 3 wherein each of the grooves of the strut cap has a near circular cross section corresponding to the near circular cross section of the end.

6. The device of claim 1 wherein the strut cap and the head are structured to substantially prevent misalignment therebetween.

7. The device of claim 6 wherein the head and the die block are structured to substantially prevent misalignment therebetween.

8. The device according to claim 2 wherein the actuator assembly housing further includes a second portion which is substantially closed, and wherein the first portion is open and sized to receive the piston mechanism.

9. The device according to claim 1 wherein the actuator assembly includes a pressure relief port structured to relieve excessive pressure against the strut cap.

10. The device according to claim 1 further comprising the first die and the second die.

11. A swaging device comprising:

a die holder assembly including a substantially U-shaped head adapted to hold a first die, and a die block adapted to hold a second die, the head being unitary structure including fixed legs of substantially equal length, and each leg having an end with near circular cross-section;

an actuator assembly, including a housing a first portion with an internal threaded surface and a piston connected to the die block, the actuator assembly being adapted to drive the die block toward the head in order to compress a workpiece positioned therebetween; and a strut cap including grooves, each having a near circular cross section, structured to slidably receive the ends of the legs, and further including a second portion with an external threaded surface structured to engage the internal threaded surface of the housing first portion, the strut cap being removably engaged to both the housing and the head, and the strut cap being structured to secure the head during the compression of the workpiece.

12. The device of claim 11 wherein the strut cap is adapted to withstand principal stresses of up to about 200 Ksi.

13. The device of claim 11 wherein the strut cap is adapted to control and distribute principal stresses on the device during the compression of the workpiece.

14. The device according to claim 11 wherein the strut cap and the head are structured to substantially prevent misalignment therebetween.

15. The device of claim 11 wherein the head and the die block are structured to substantially prevent misalignment therebetween.

16. The device according to claim 11 wherein the first portion, of the actuator assembly housing, is open and sized to receive the piston mechanism.

17. The device according to claim 11 wherein actuator assembly includes a pressure relief port structured to relieve excessive pressure against the strut cap.

18. The device according to claim 16 wherein the actuator assembly housing further includes a substantially closed second portion.

19. The device according to claim 11 further comprising the first die and the second die.

* * * * *

UNITED STATES PATENT AND TRADEMARK OFFICE

CERTIFICATE OF CORRECTION

PATENT NO. : 6,769,283 B2
DATED : August 3, 2004
INVENTOR(S) : Srinivas B. Suresh It is certified that error appears in the above-identified patent and that said Letters Patent is hereby corrected as shown below:

Column 2,
Line 18, please delete “un-shaped” and insert -- u-shaped -- therein.

Column 6,
Line 63, after “structured to engage” add -- the -- therein.

Column 7,
Line 34, after “including a housing” add -- having -- therein.

Signed and Sealed this

Fifteenth Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 6,769,283 B2
DATED : August 3, 2004
INVENTOR(S) : Srinivas B. Suresh It is certified that error appears in the above-identified patent and that said Letters Patent is hereby corrected as shown below:

Title page,
Item [56], References Cited, U.S. PATENT DOCUMENTS, please add the following:

| | | | |
|---|---|---|---|
| -- 3,823,597* | 7/1974 | Hanback et al. | 72/402 |
| 3,848,451* | 11/1974 | Allin | 72/402 |
| 4,942,757* | 7/1990 | Pecora | 72/453.16 |
| 4,947,672* | 8/1990 | Pecora et al. | 81/301 |
| 5,335,530* | 8/1994 | Homm | 72/402 |
| 6,230,542* | 5/2001 | Frenken | 72/453.16 -- |

Signed and Sealed this

Fourteenth Day of June, 2005

JON W. DUDAS
*Director of the United States Patent and Trademark Office*